US006340184B1

(12) United States Patent
Kuzmich

(10) Patent No.: US 6,340,184 B1
(45) Date of Patent: Jan. 22, 2002

(54) SECURITY DEVICE FOR SLIDING DOORS AND WINDOWS

(76) Inventor: Alan Paul Kuzmich, 4 Summerfield Cres., Brampton, Ontario (CA), L6X-4L3

( * ) Notice: Subject to any disclaimer, the term of this patent is extended or adjusted under 35 U.S.C. 154(b) by 0 days.

(21) Appl. No.: 09/482,280

(22) Filed: Jan. 13, 2000

(51) Int. Cl.[7] ..... E05C 19/18

(52) U.S. Cl. ..... 292/259 R; 292/342; 292/DIG. 46; 292/262

(58) Field of Search ..... 292/259 R, 342, 292/343, 253–255, 262, 263, DIG. 46; 49/449

(56) References Cited

U.S. PATENT DOCUMENTS

| | | | | | |
|---|---|---|---|---|---|
| 1,653,406 | A | | 12/1927 | Neubert | |
| 3,486,781 | A | * | 12/1969 | Crum | 292/262 |
| D219,362 | S | | 12/1970 | Snyder | D8/203 |
| 4,070,049 | A | * | 1/1978 | Brewer | 292/263 |
| 4,073,522 | A | * | 2/1978 | Tierney | 292/262 |
| 4,318,559 | A | * | 3/1982 | Burton | 292/263 |
| 4,429,912 | A | | 2/1984 | Smith | 292/263 |
| 4,572,557 | A | | 2/1986 | Taylor | 292/263 |
| 5,685,582 | A | | 11/1997 | McCartney | 292/339 |

FOREIGN PATENT DOCUMENTS

| | | |
|---|---|---|
| EP | 0 687 786 A1 | 5/1995 |

* cited by examiner

*Primary Examiner*—Gary Estremsky

(57) ABSTRACT

A security device has two telescoping arms and a hinge plate at the center for releasing the locked telescoping arms which can be actuated by a persons foot. A spring tensioned telescoping arm prevents unintentional engagement of the security device.

4 Claims, 2 Drawing Sheets

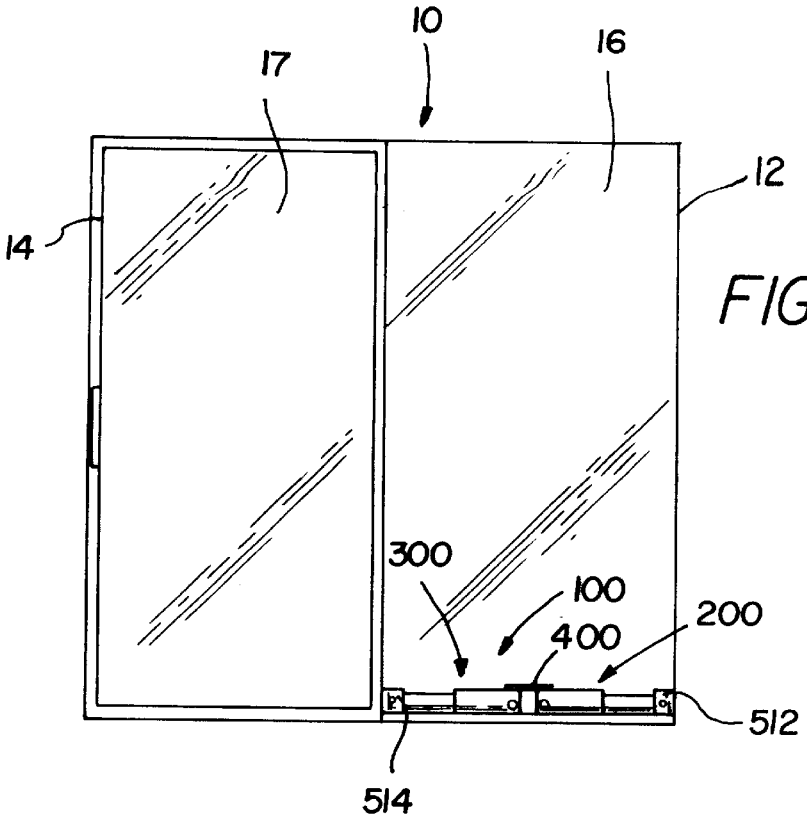
FIG.1
FIG.2
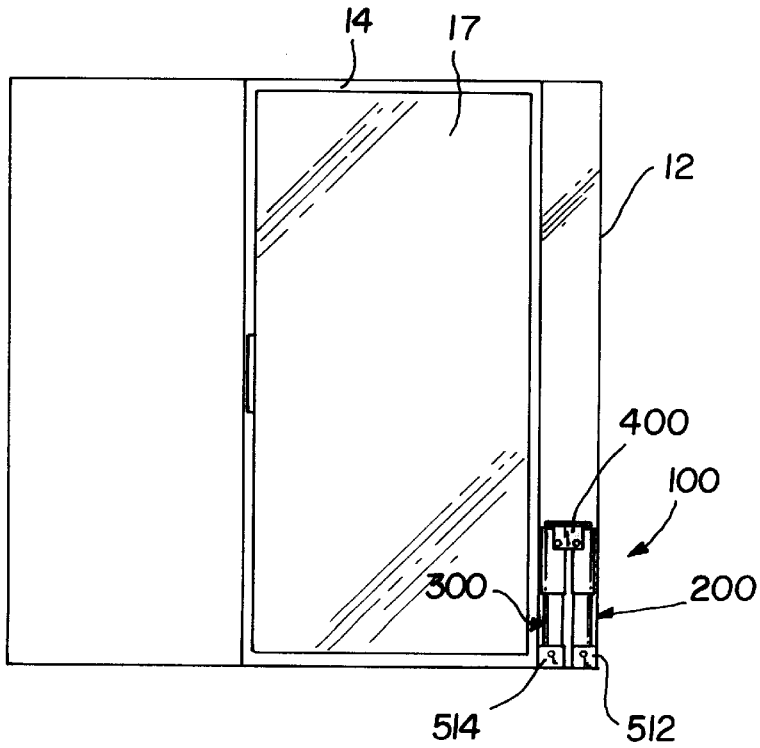

SECURITY DEVICE FOR SLIDING DOORS AND WINDOWS

BACKGROUND OF THE INVENTION

1. Field of the Invention

The present invention relates to devices for securing a sliding glass door or window in a closed position while permitting folding of the device when the door or window is opened.

2. Description of the Prior Art

Windows and sliding glass doors of a building are vulnerable to attempts to gain unauthorized entry to the building because the standard releasable latch which retains the door or window in a locked position can be broken by a pry bar inserted between the movable door or window and the jamb member of the support frame.

A common device to increase the strength of the window or sliding glass door is a bar placed between the frame of the sliding glass door or window and the opposing jamb member. The bar serves as a compressive device to prevent movement of the door or window and is removed when the door or window is opened. The prior art includes a number of improvements on the simple bar, principally involving a bar in two sections that can be folded when unlocked and that also can be locked into an extended position for securing the door or window. U.S. Pat. No. 4,429,912 to Smith, Jr. discloses first and second bar sections pivotally connected to each other. U.S. Pat. No. 4,572,557 to Taylor discloses a first and second tubular bar hingedly secured together with pivotal end plates and a sliding member for locking the two bars in an extended position. U.S. Pat. No. 5,685,582 to McCartney discloses two pivotally connected overlapping bars with a releaseable sliding mechanism for locking the bars in position. However, a need exists for a strong security bar that can be adjusted to fit the doorway or window to which it is installed and which can be locked and unlocked easily without bending or stooping.

SUMMARY OF THE INVENTION

The present invention meeting the needs identified above is a security device having two telescoping arms and a hinge plate at the center for releasing the locked telescoping arms which can be actuated by a persons foot. A spring tensioned telescoping arm prevents unintentional locking of the security device.

BRIEF DESCRIPTION OF THE DRAWINGS

FIG. 1 is a front view of a sliding glass door with the security device in the locked position.

FIG. 2 is a front view of a sliding glass door with the security device in the open position.

DESCRIPTION OF PREFERRED EMBODIMENTS

Figure 3:
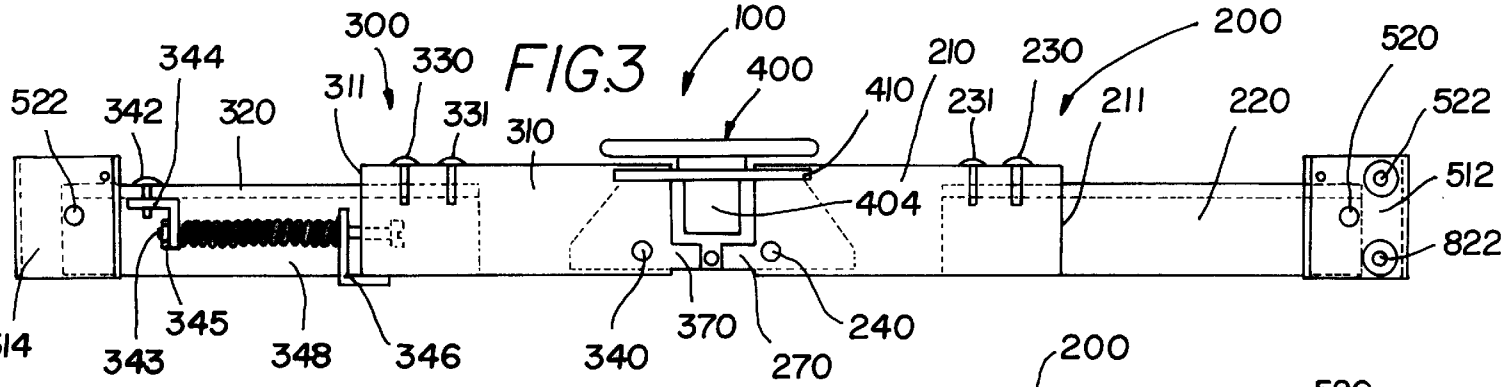
FIG. 3 is a side view of the security device.

In FIG. 1 sliding glass door unit 10 is shown as viewed from the interior of a building. First doorframe 12 contains first door glass 16 and second door frame 14 contains second door glass 17. Security device 100 is attached to first door frame 12 by first mounting bracket 512 and to second door frame 14 by second mounting bracket 514. Security device

100 consists of first telescoping arm 200, second telescoping arm 300 and hinge plate 400.

FIG. 2 shows second door frame 14 in the open position and security device 100 rotated about first mounting bracket 512, second mounting bracket 514 and hinge plate 400 so that first telescoping arm 200 is in a vertical position, second telescoping arm 300 is in a vertical position and first telescoping arm 200 is parallel to second telescoping arm 300.

FIG. 3 shows a side view of security device 100. First telescoping arm 200 has first mounting bracket 512, first arm housing 210 and first arm 220. First arm 220 is rotatably connected to first mounting bracket 512 by first connecting bolt 520 and first connecting bolt nut 521. First arm 220 is fixedly connected to first arm housing 210 by tightening first threaded bolt 230 into one of first threaded holes 236 and second threaded bolt 231 into another of first threaded holes 236. First mounting bracket 512 has first mounting bracket side holes 522. Second telescoping arm 300 has first mounting bracket 514, second arm housing 310 and second arm 320. Second arm 320 is rotatably connected to second mounting bracket 514 by second connecting bolt 522 and second connecting bolt nut 523. Second arm 320 is adjustably connected to second arm housing 310 by third threaded bolt 330 and fourth threaded bolt 331 which are threadedly engaged to selected second threaded holes 336 so as to allow movement of third threaded bolt 330 and fourth threaded bolt 331 within first elongated hole 338 of second arm 310 and second elongated hole 339 of second arm 310 respectively. Movement of third threaded bolt 330 and fourth threaded bolt 331 within first elongated hole 338 and second elongated hole 339 is necessary for maintaining security device 100 in an unlocked position as will be explained further below. Second arm 320 has spring adjustment bracket 344 connected to second arm 320 by fifth threaded bolt 342. Spring 348 is connected to spring adjustment bracket 344 by spring threaded bolt 343 and nut 345. Spring 348 is also connected to spring mounting bracket 346 by spring threaded bolt 343 which is slidingly engaged to spring mounting bracket 346 passing through a hole (not shown) in spring mounting bracket 346. Spring mounting bracket 346 is "L" shaped and is fixedly engaged to second arm outer end 311. In the preferred embodiment, spring mounting bracket 346 is welded to second arm outer end 311. Spring 348 exerts pressure on spring mounting bracket 346 which is fixedly engaged to second arm outer end 311 so that security device will not go to a horizontal position under its own weight but only when intentionally pressed into a horizontal position by outside pressure being applied to foot pad 402 of hinge plate 400. In FIG. 3, first telescoping arm 200 and second telescoping arm 300 are rotatably connected to hinge plate 400 by first interlocking threaded bolt receiver 241 and first interlocking threaded bolt 240 and second interlocking threaded bolt receiver 341 and second interlocking threaded bolt 340 respectively. Hinge plate 400 has foot pad 402 and release lever 410 (Shown in FIG. 5). Release lever 410 is hingedly connected to foot pad 402 and fixedly connected to tab stop 404. Tab stop 404 is in the same plane with first arm housing tab 270 and second arm housing tab 370.

Figure 4:
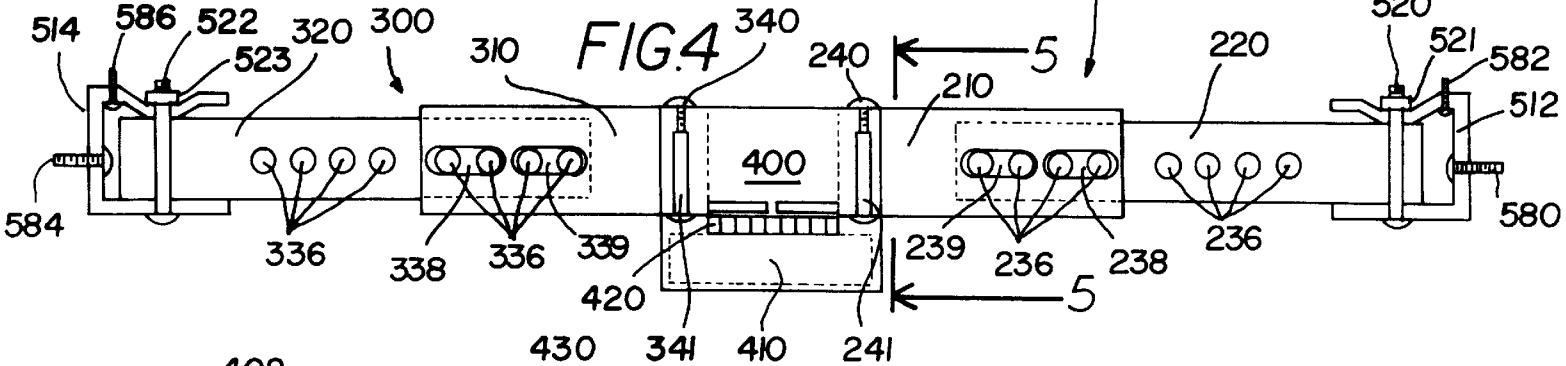
FIG. 4 is a top view of the security device.

FIG. 4 shows a top view of security device 100. First mounting bracket 512 is rotatably engaged to first arm 220 by first rivet 520. First mounting bracket 512 has first door bolt 580 and second door bolt 582 for affixing first mounting bracket to doorjamb 12 (See FIGS. 1 and 2). Second mounting bracket 514 has third door bolt 584 and fourth door bolt 586 for affixing second mounting bracket 514 to door frame 14 (See FIGS. 1 and 2). Foot pad 402 can be used to help extend security apparatus from the open position shown in FIG. 2 to the closed position shown in FIG. 1 by applying pressure to foot pad 402 while moving the door toward the closed position. First arm 220 has a plurality of holes in the top of first arm 220. FIG. 1 shows eight holes. However, any number can be used to increase the adaptability of security device 100 to a variety of door frames. First arm bolt holes 236 are round. First arm housing 210 has elongated bolt hole 238 and elongated bolt hole 239 designed to allow small scale adjustment of the length of first telescoping arm 200. Second arm 320 has a plurality of holes in the top of second arm 320. FIG. 4 shows eight holes. However, any number can be used to increase the adaptability of security device 100. Second arm housing 310 has second arm first elongated bolt hole 338 and second arm second elongated bolt hole 339 to allow movement of third threaded bolt 331 and fourth threaded bolt 330. Moreover, movement of third threaded bolt 331 and fourth threaded bolt 330 in second arm first elongated bolt hole 338 and second arm second elongated bolt hole 339, respectively, is desirable as spring 348 (See FIG. 3) provides tension for maintaining security device 100 in an unlocked position. Spring 348 is held in position by spring threaded bolt 343.

Figure 5:
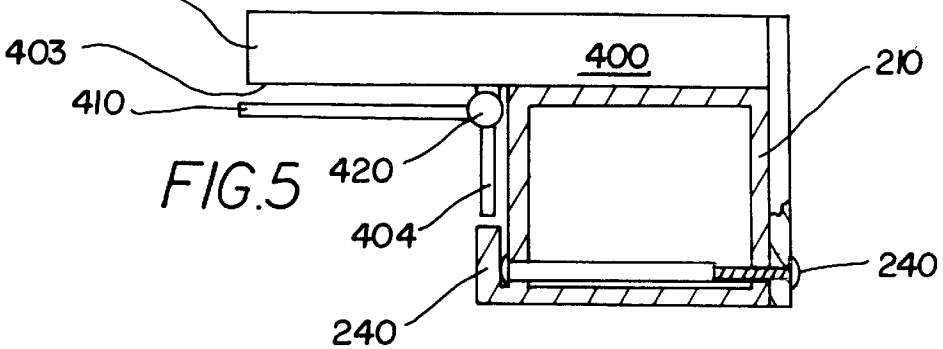
FIG. 5 is a cross section view of the security device along line 5—5 of FIG. 4.

FIG. 5 shows a cross section of second arm housing 200 at line 5—5. Foot pad 402 is a solid piece. Hinge 420 is fixedly engaged to foot pad underside 403 by hinge anchor section 430. Release lever 410 and tab stop 404 are fixedly connected to each other and rotate about hinge 420. Upward displacement of release lever 410 moves tab stop 404 out and away from first arm housing tab 270 allowing rotation of first arm housing 210 about hinge plate 400. Likewise, when release lever 410 is moved upward, tab stop 404 will move out and away from second arm housing tab 370, allowing rotation of second arm housing 310 about hinge plate 400.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. An apparatus comprising:

a first telescoping arm;

a second telescoping arm;

a hinge plate rotatably connected to said first telescoping arm and to said second telescoping arm;

a foot pad fixedly engaged to said hinge plate;

a release lever hingedly connected to said foot pad; and a tab stop fixedly connected to said release lever.

2. The first telescoping arm of claim 1 further comprising:

a first arm housing;

a first arm adjustably engaged to said first arm housing.

3. The second telescoping arm of claim 1 further comprising:

a second arm housing;

a second arm adjustably engaged to said second arm housing; and a spring connected to said second arm and to said second arm housing wherein said spring prevents said first telescoping arm and said second telescoping arm from attaining a horizontal position without the application of pressure to the foot pad.

4. An apparatus comprising:

a first telescoping arm comprising;

a first arm housing; and a first arm adjustably engaged to said first arm housing;

a second telescoping arm comprising;

a second arm housing;

a second arm adjustably engaged to said second arm housing;

a spring connected to said second arm and to said second arm housing wherein said spring prevents said first telescoping arm and said second telescoping arm from attaining a horizontal position without the application of pressure to a foot pad;

a hinge plate having rotatably connected to said first telescoping arm and to said second telescoping arm, said hinge plate fixedly engaged to the foot pad;

a release lever hingedly connected to the foot pad; and a tab stop fixedly connected to said release lever.

* * * * *